US009279624B2

(12) United States Patent
Lee et al.

(10) Patent No.: US 9,279,624 B2
(45) Date of Patent: Mar. 8, 2016

(54) HEAT EXCHANGER TUBE WITH COLLARED FINS FOR ENHANCED HEAT TRANSFER

(75) Inventors: Sangmu Lee, Tokyo (JP); Masahiko Takagi, Tokyo (JP); Akira Ishibashi, Tokyo (JP); Takuya Matsuda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 200 days.

(21) Appl. No.: 14/002,833

(22) PCT Filed: Mar. 1, 2011

(86) PCT No.: PCT/JP2011/001170

§ 371 (c)(1), (2), (4) Date: Sep. 3, 2013

(87) PCT Pub. No.: WO2012/117440

PCT Pub. Date: Sep. 7, 2012

(65) Prior Publication Data

US 2013/0340986 A1 Dec. 26, 2013

(51) Int. Cl.
*F28D 1/04* (2006.01)
*F28F 1/12* (2006.01)
(Continued)

(52) U.S. Cl.
CPC ... *F28F 1/12* (2013.01); *F28D 7/06* (2013.01); *F28F 1/32* (2013.01); *F28F 1/42* (2013.01);
(Continued)

(58) Field of Classification Search
CPC ..... F28F 1/12; F28F 1/24; F28F 1/30; F28F 1/42; F28F 1/422; F28F 2275/125; F28F 2275/12; F28D 7/06; F28D 2021/00; F28D 2021/0068; F28D 2001/428; F28D 1/053
USPC ..... 165/DIG. 346, DIG. 444, DIG. 445, 165/DIG. 504; 29/890.04
See application file for complete search history.

(56) References Cited

U.S. PATENT DOCUMENTS 2,007,838 A * 7/1935 Scott et al. ..... 165/81
3,889,745 A * 6/1975 Siemonsen ..... 165/151
(Continued)

FOREIGN PATENT DOCUMENTS

DE 92 13 724.5 U1 4/1993
JP 62-124040 A 6/1987
(Continued)

OTHER PUBLICATIONS

Extended European Search Report dated Feb. 3, 2015 issued in corresponding EP patent application No. 11859764.0.
(Continued)

*Primary Examiner* — Frantz Jules
*Assistant Examiner* — Jose O Class-Quinones
(74) *Attorney, Agent, or Firm* — Posz Law Group, PLC

(57) ABSTRACT

A fin and tube heat exchanger includes a plurality of heat transfer tubes arranged in parallel and a plurality of plate-shaped fins provided orthogonally to the heat transfer tubes, each of the heat transfer tubes is in contact with fin collars of the plate-shaped fins and is inserted along the fin collars. Each fin collar is configured to include a bend in each of a re-flared portion and in a root portion of the fin collar. A thickness of the re-flared portion is smaller than a thickness of the root portion and a radius of the bend of the re-flared portion is larger than a radius of the bend of the root portion.

4 Claims, 7 Drawing Sheets

(51) Int. Cl.

| | |
|---|---|
| ***F28F 1/32*** | (2006.01) |
| ***F28F 1/42*** | (2006.01) |
| ***F28D 7/06*** | (2006.01) |
| *B21D 53/08* | (2006.01) |
| *F28D 21/00* | (2006.01) |

(52) U.S. Cl.

CPC ..... *B21D 53/08* (2013.01); *F28D 2021/0068* (2013.01); *F28F 2001/428* (2013.01); *F28F 2275/125* (2013.01)

(56) References Cited

U.S. PATENT DOCUMENTS

| | | | | | |
|---|---|---|---|---|---|
| 3,916,989 | A | * | 11/1975 | Harada et al. | 165/151 |
| 4,428,107 | A | * | 1/1984 | Mack et al. | 29/890.04 |
| 4,502,532 | A | * | 3/1985 | Tomozaki et al. | 165/79 |
| 4,580,623 | A | * | 4/1986 | Smitte et al. | 165/150 |
| 5,275,234 | A | * | 1/1994 | Booth | 165/133 |
| 5,554,234 | A | * | 9/1996 | Takeuchi et al. | 148/551 |
| 5,660,230 | A | * | 8/1997 | Obosu et al. | 165/151 |
| 5,692,560 | A | * | 12/1997 | Messant et al. | 165/151 |
| 5,921,130 | A | * | 7/1999 | Yamada | 72/358 |
| 6,202,703 | B1 | * | 3/2001 | Kuroda et al. | 138/178 |
| 6,209,201 | B1 | * | 4/2001 | Yamada | 29/890.045 |
| 6,266,882 | B1 | * | 7/2001 | Ali et al. | 29/890.046 |
| 2010/0218533 | A1 | * | 9/2010 | Lee | 62/259.1 |

FOREIGN PATENT DOCUMENTS

| | | | |
|---|---|---|---|
| JP | 04-081232 | A | 3/1992 |
| JP | 04-123828 | A | 4/1992 |
| JP | 3188645 | B2 | 7/2001 |
| JP | 2001-221587 | A | 8/2001 |
| JP | 2003-329385 | A | 11/2003 |
| JP | 2005-134053 | A | 5/2005 |
| JP | 2008-232499 | A | 10/2008 |
| JP | 2010-223578 | A | 10/2010 |

OTHER PUBLICATIONS

Office Action mailed Oct. 30, 2014 issued in corresponding RU patent application No. 2013143959/06 (067701) (and English translation).

Office Action mailed May 13, 2014 issued in corresponding JP patent application No. 2013-502037 (and English translation).

International Search Report of the International Searching Authority mailed Apr. 5, 2011 for the corresponding international application No. PCT/JP2011/001170 (with English translation).

Office Action mailed Jan. 9, 2015 issued in corresponding CN patent application No. 201180068777.6 (and English translation).

Nakata, "Economic efficiency and optimal setting in heat exchanger for air-conditioner," Kikai No Kenkyu, 1989; vol. 41, No. 9: pp. 1005-1011.

* cited by examiner

HEAT EXCHANGER TUBE WITH COLLARED FINS FOR ENHANCED HEAT TRANSFER

CROSS REFERENCE TO RELATED APPLICATION

This application is a U.S. national stage application of PCT/JP2011/001170 filed on Mar. 1, 2011, the disclosure of which is incorporated herein by reference.

TECHNICAL FIELD

The present invention relates to a heat exchanger employed in refrigerators and air-conditioning apparatuses, for example, and relates to a refrigerator and an air-conditioning apparatus that are equipped with the heat exchanger.

BACKGROUND

Conventional heat exchangers employed in refrigerators and air-conditioning apparatuses include those which are called fin and tube heat exchangers. One such heat exchanger is constituted by: plate-shaped fins that are arranged at a fixed interval and between which gas (air) passes through; and heat transfer tubes that are inserted at right angle through these plate-shaped fins (hereinafter, simply referred to as "fins") and through which a refrigerant flows. Known factors of influence on the heat transfer performance of this fin and tube heat exchanger include a heat transfer coefficient on the refrigerant side between the refrigerant and the heat transfer tubes, a contact heat transfer coefficient between the heat transfer tubes and the fins, and an air-side heat transfer coefficient between the air and the fins.

In order to increase the heat transfer coefficient on the refrigerant side between the refrigerant and the heat transfer tubes, performance inside the tubes is facilitated by increasing area of the heat transfer tubes and by cutting inner grooves, which allows a stirring effect of the refrigerant to be obtained, in the heat transfer tubes. Furthermore, in order to enhance the air-side heat transfer coefficient between the air and the fins, slit groups, which are formed by performing cutting and raising of the fins, are provided between adjoining heat transfer tubes. These slit groups are provided so that the edges of the slits face the wind direction. By thinning the hydrodynamic boundary layer and the thermal boundary layer of the air flow at these edges, heat transfer is facilitated and heat exchange capacity is increased. Furthermore, the contact heat transfer coefficient between the heat transfer tubes and the fins are influenced by the contact condition between the heat transfer tubes and the fins.

For example, as illustrated in FIG. 8, when a heat transfer tube 10 is expanded and is fixed to fins 1, there occurs, between the outer surface of the heat transfer tube 10 and the fins 1, gaps caused by waviness of the outer surface of the heat transfer tube 10, gaps caused by deformation of the intermediate portion of a fin collar 2, and a gap between a fin 1 and a fin 1. The drop in contact heat transfer coefficient owing to these gaps is considered to be about five percent of the heat exchanger (see Non Patent Literature 1, for example).

Accordingly, in order to reduce these gaps and increase the contact heat transfer coefficient, a technique has been proposed, for example, as illustrated in FIG. 9, in which three or more bends R are provided for the fin collar 2 of the fin 1 along which the heat transfer tube 10 is inserted. In this technique, further, the bends R are smoothly connected to each other, the fin collar 2 is generally shaped to convex to the heat transfer tube 10 side, with no straight portion existing (See Patent Literature 1).

PATENT LITERATURE

Patent Literature 1: Japanese Patent No. 3356151 (Claims, FIG. 1)

Non Patent Literature 1: Nakata, "Economic efficiency and optimal setting in heat exchanger for air-conditioner", Kikai No Kenkyu, 1989; Vol. 41, No. 9: pp. 1005-1011.

However, the conventional technique described above has the following problem. In the technique described in Patent Literature 1, three or more bends R are provided to each fin collar 2, and, further, the bends R are smoothly connected to each other, the shape of the fin collar 2 is, as a whole, a convex to the heat transfer tube 10 side, and no straight portion exists. Accordingly, due to defective fabrication of the bend R, when the heat transfer tube 10 is disposed into the fin collar 2, increase in insertion force is caused and mass production cost is increased; thus, a problem occurs in that the intended heat transfer performance cannot be obtained.

SUMMARY

The present invention is made to overcome the above problem and an object thereof is to provide a heat exchanger that can increase its heat exchange capacity by a reduced thermal contact resistance between the heat transfer tubes and the fin collars of the fins, and, further, to provide a refrigerator and an air-conditioning apparatus provided with this heat exchanger.

The present invention is a fin and tube heat exchanger including a plurality of heat transfer tubes arranged in parallel to each other and a plurality of plate-shaped fins provided orthogonally to the heat transfer tubes. Each of the heat transfer tubes is in contact with fin collars of the plate-shaped fins, and inserted along the fin collars.

Each fin collar is configured such that a bend is provided in each of a re-flared portion and a root portion of the fin collar, a thickness of the re-flared portion is small as compared to a thickness of the root portion, and a radius of the bend of the re-flared portion is large as compared to a radius of the bend of the root portion.

The refrigerator or air-conditioning apparatus according to the invention is provided with the above heat exchanger.

According to the present invention, a heat exchanger can be obtained in which the thermal contact resistance between the heat transfer tubes and the fin collars are reduced and in which the heat exchange capacity can be increased, and, a refrigerator and an air-conditioning apparatus provided with this heat exchanger can be obtained.

DESCRIPTION OF EMBODIMENTS

First Embodiment

Figure 1:
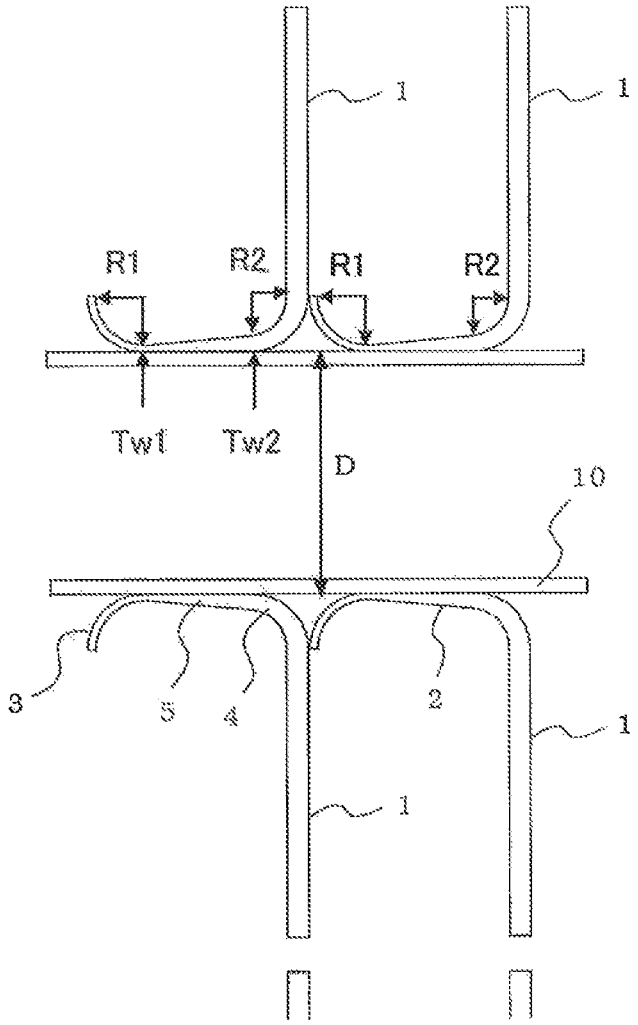
FIG. 1 is an enlarged cross-sectional view of a principal portion of a heat exchanger according to a first embodiment of the invention.

FIG. 1 is an enlarged cross-sectional view of a principal portion of a heat exchanger according to a first embodiment of the invention after a tube of the heat exchanger has been expanded. Referring to FIG. 1, reference numeral 1 denotes a fin that is formed of a plate made of heat-resisting metal, such as copper alloy or aluminum alloy (similar in the other embodiments), and, a heat transfer tube 10 made from a metallic material, such as copper or copper alloy, or aluminum or aluminum alloy (similar in the other embodiments), is provided orthogonally to the fins 1.

Figure 2:
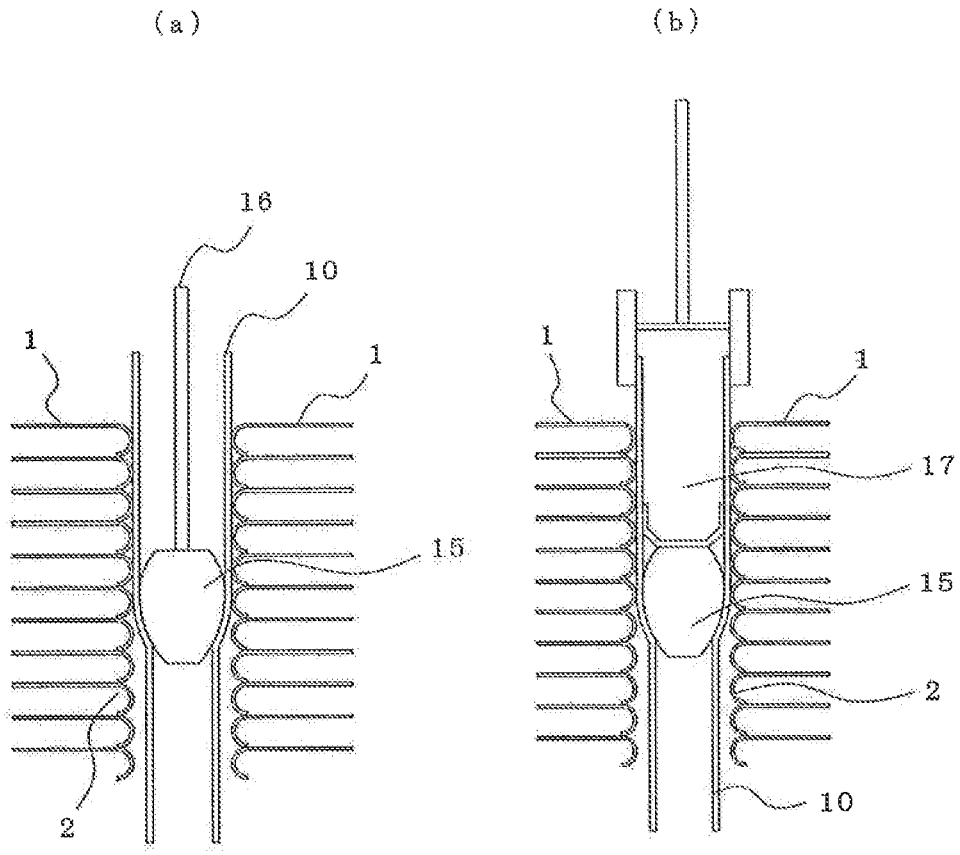
FIG. 2 includes explanatory diagrams of a manufacturing method of the heat exchanger according to the first embodiment.

FIGS. 2(*a*) and 2(*b*) are explanatory diagrams illustrating a manufacturing method of the heat exchanger according to the first embodiment of the invention.

In manufacturing the heat exchanger, a plurality of hair-pin tubes is first fabricated by bending, into a hair-pin shape, a middle portion of individual heat transfer tubes 10 in the longitudinal direction at a predetermined bending pitch. Subsequently, each of these hair-pin tubes is inserted between the fin collars 2 and the fin collars 2, of the plurality of fins 1 that are arranged in parallel to each other at a predetermined interval. Then, each hair-pin tube is expanded by a mechanical tube expanding method in which a tube expanding ball 15 is pushed into the hair-pin tube with a rod 16, as illustrated in FIG. 2(*a*), or is expanded by a hydraulic tube expanding method in which the tube expanding ball 15 is pushed into the hair-pin tube with a fluid 17, as illustrated in FIG. 2(*b*). As such, each fin 1 and the hair-pin tubes, that is, the heat transfer tubes 10, are joined together. In this way, the fin and tube heat exchanger is manufactured.

The heat exchanger that is manufactured as above includes the plurality of heat transfer tubes 10 that are arranged in parallel to each other and the plurality of fins 1 that are orthogonally to the heat transfer tubes 10. The heat transfer tubes 10 are in contact with the fin collars 2 of the fins 1, along which fin collars the heat transfer tubes 10 are inserted.

As regards the shape of the fin collar 2, a re-flared portion 3 and a root portion 4 are each provided with an arc-shaped bend and each have a radius of R1 and R2, respectively; a thickness Tw1 of the re-flared portion 3 is formed to be smaller than a thickness Tw2 of the root portion 4; and a ratio (Tw1/R1) of the thickness Tw1 to the radius R1 of the bend of the re-flared portion 3 is one half or more of a ratio (Tw2/R2) of the thickness Tw2 to the radius R2 of the bend of the root portion 4. Note that an intermediate portion 5, whose outer surface side is flat, is provided between the bend of the re-flared portion 3 and that of the root portion 4. As a whole, a substantially J-shape fin is formed.

In this case, when the radius R1 of the bend of the re-flared portion 3 of the fin collar 2 is formed larger than the radius R2 of the bend of the root portion 4, then, after the expansion of the heat transfer tube 10, a contact area of a root portion 4 of the fin collar 2 of the fin 1 at the front and a re-flared portion 3 of the fin collar 2 of the fin 1 at the back is increased and thermal contact resistance is reduced; thus, heat exchange capacity is increased.

Figure 3:
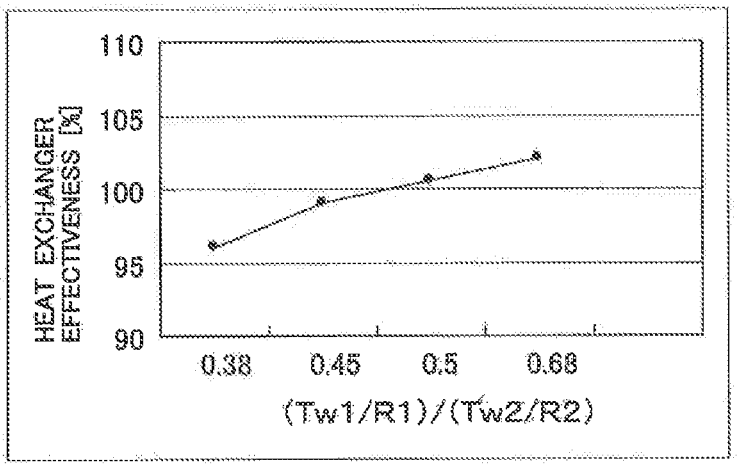
FIG. 3 is a diagram showing a relationship between a ratio of thickness to radius of each bend of the fin collar and a heat exchanger effectiveness of the heat exchanger according to the first embodiment.
Figure 4:
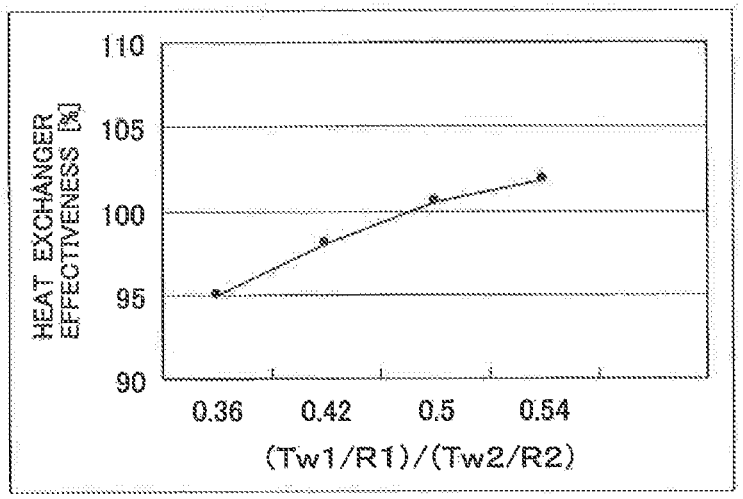
FIG. 4 is a diagram showing a relationship between a ratio of thickness to radius of each bend of the fin collar and a heat exchanger effectiveness of the heat exchanger according to the first embodiment.

FIGS. 3 and 4 are diagrams each illustrating a relationship between the relationship and the heat exchanger effectiveness, the relationship being between the thickness Tw1 and the radius R1 of the bends of the re-flared portion 3 of the fin collar 2 and between the thickness Tw2 and the radius R2 of the root portion 4 of the fin collar 2.

The radius R1 of the bend of the re-flared portion 3 of the fin collar 2 has a close relationship with the thickness Tw1 of the re-flared portion 3; accordingly, when the radius R1 of the bend of the re-flared portion 3 is to be increased, the thickness Tw1 of the re-flared portion 3 also needs to be increased. If the thickness Tw1 of the re-flared portion 3 is small when the radius R1 of the bend of the re-flared portion 3 of the fin collar 2 is large, stress will concentrate on the re-flared portion 3, and the contact pressure between the intermediate portion 5 and the heat transfer tube 10 will drop. Accordingly, thermal contact resistance will increase and heat exchange capacity will drop.

Furthermore, when the ratio (Tw1/R1) of the thickness Tw1 to the radius R1 of the bend of the re-flared portion 3 of the fin collar 2 is one half or less of the ratio (Tw2/R2) of the thickness Tw2 to the radius R2 of the bend of the root portion 4, then the contact pressure between the root portion 4 of the fin collar 2 of the fin 1 at the front and the re-flared portion 3 of the fin collar 2 of the fin 1 at the back will drop. Accordingly, the contact pressure between the intermediate portion 5 of the fin collar 2 and the heat transfer tube 10 will drop and the thermal contact resistance will increase, leading to drop in heat exchange capacity.

Therefore, it is desirable that the ratio (Tw1/R1) of the thickness Tw1 to the radius R1 of the bend of the re-flared portion 3 of the fin collar 2 is 0.6 or larger with respect to the ratio (Tw2/R2) of the thickness Tw2 to the radius R2 of the bend of the root portion 4.

Second Embodiment

Figure 5:
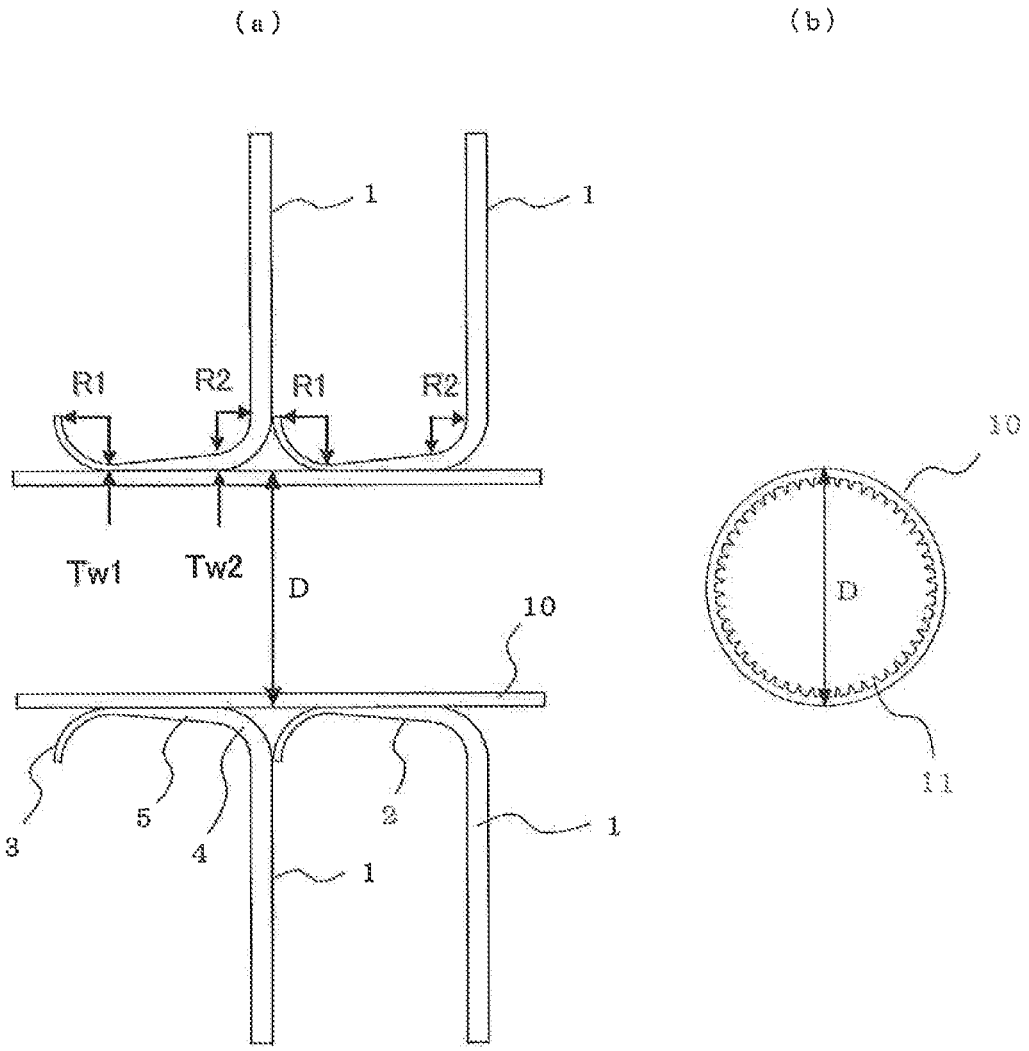
FIG. 5 includes an enlarged view of a principal portion of a heat exchanger and a cross-sectional view of a heat transfer tube according to a second embodiment of the present invention.

FIG. 5 is an enlarged cross-sectional view of a principal portion of a heat exchanger and a cross-sectional view of a heat transfer tube according to a second embodiment of the invention. Note that like parts as the first embodiment are designated with like reference numerals.

In the figure, reference numeral 1 denotes a fin that is formed from a plate made of heat-resisting metal, such as copper alloy or aluminum alloy. A heat transfer tube 10 that is made from a metallic material, such as copper, copper alloy, aluminum, or aluminum alloy, and that is provided with a plurality of inner protrusions 11 arranged in the axial direction of the inner circumferential surface is provided orthogonally to the fins 1.

The heat exchanger according to the second embodiment is configured such that a bend is provided to a re-flared portion 3 and to a root portion 4 of a fin collar 2 of each fin 1; a ratio (Tw1/R1) of a thickness Tw1 to a radius R1 of the bend of the re-flared portion 3 is configured to be one half or more of a ratio (Tw2/R2) of a thickness Tw2 to a radius R2 of the bend of the root portion 4; and the result of a relational expression (3.14×D/N)×((Tw1+Tw2)/2)/Tw2 is within a range from 0.26 to 0.34, in which the relational expression is a product of a ratio (3.14×D/N) of a circumferential length (3.14×D) of the heat transfer tube 10 having an outer diameter D to the total number of threads N of the inner protrusions 11 by a ratio ((Tw1+Tw2))/2/Tw2 of a mean thickness (Tw1+Tw2)/2 of the intermediate portion 5 of the fin collar 2 to the thickness Tw2 of the root portion 4 of the fin collar 2.

Subsequently, the reason for the numerical limitation of the second embodiment will be described.

Figure 6:
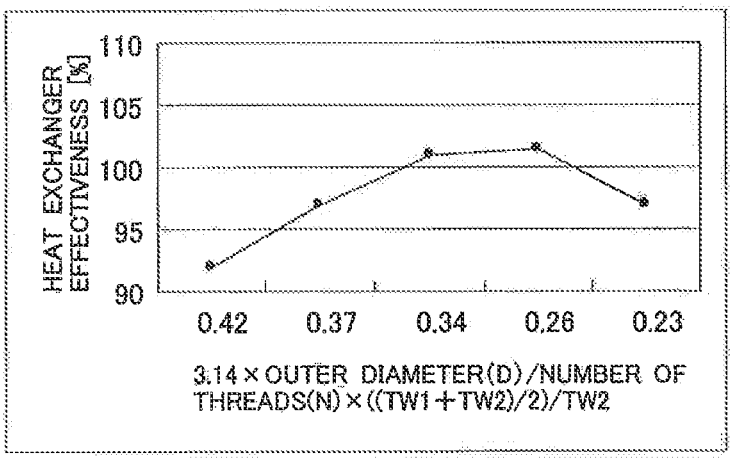
FIG. 6 is a diagram showing a relationship between a relational expression and a heat exchanger effectiveness, of the heat exchanger according to the second embodiment, in which the relational expression represents the relation among thicknesses of a fin collar, an outer diameter of the heat transfer tube, and the number of threads of inside protrusions.
Figure 7:
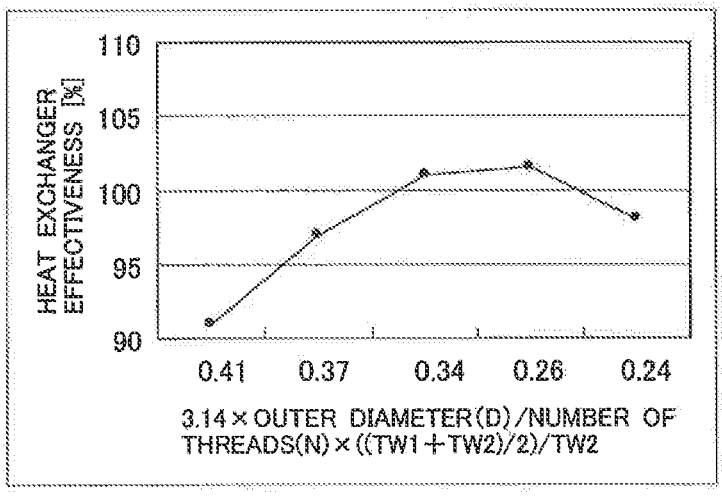
FIG. 7 is a diagram showing a relationship between the relational expression and the heat exchanger effectiveness, of the heat exchanger according to the second embodiment, in which the relational expression represents the relation among thicknesses of the fin collar, an outer diameter of the heat transfer tube, and the number of threads of the inside protrusions.
Figure 8:
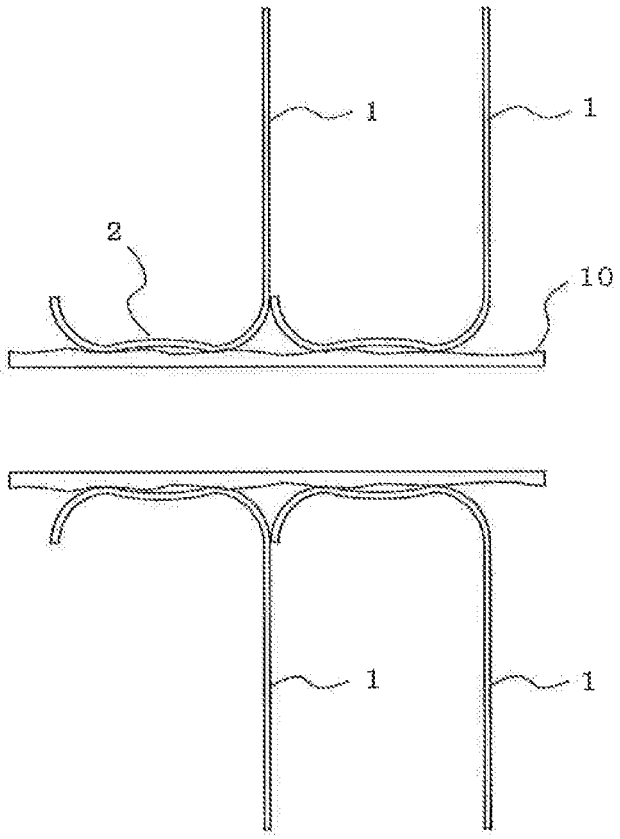
FIG. 8 PRIOR ART
FIG. 8 is an enlarged cross-sectional view of a principal portion of a conventional fin and tube heat exchanger.
Figure 9:
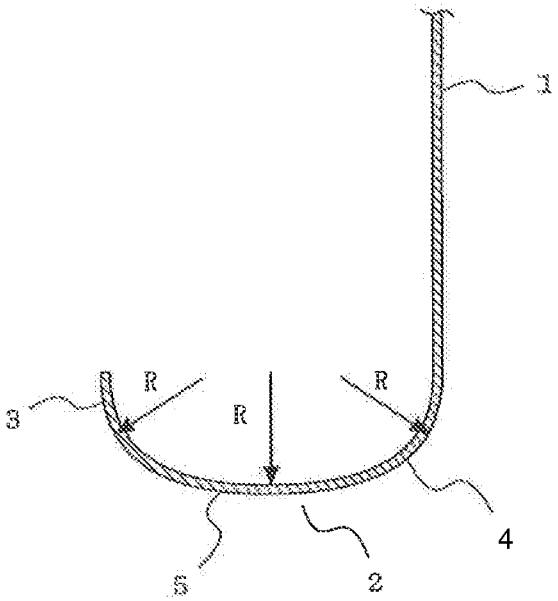
FIG. 9 PRIOR ART
FIG. 9 is au explanatory diagram of a fin of FIG. 8.
Figure 10:
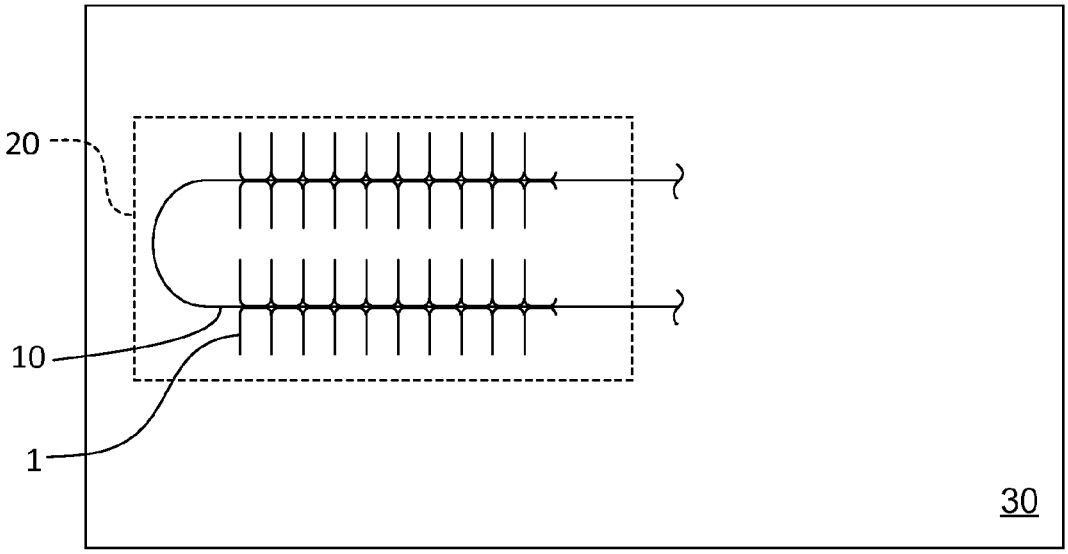
FIG. 10 is a schematic diagram of a heat exchanger according to the invention within a heat exchanging device.

FIGS. 6 and 7 are diagrams showing a relationship between the following two: one is a relational expression showing the relation among thicknesses Tw of the fin collar 2 of the fin 1, the outer diameter D of the heat transfer tube 10, and the number of threads N of the inner protrusions 11 of the heat transfer tube 10; and the other is a heat exchanger effectiveness (%).

As shown in FIGS. 6 and 7, in order for the heat exchanger to maintain its heat exchange capacity, the relational expression (3.14×D/N)×((Tw1+Tw2)/2)/Tw2, which is the product of the ratio (3.14×D/N) of the circumferential length (3.14×D) of the heat transfer tube 10 having the outer diameter D to the number of threads N of the inner protrusions 11 by the ratio ((Tw1+Tw2)/2))/Tw2 of the mean thickness (Tw1+Tw2)/2 of the intermediate portion 5 of the fin collar 2 to the thickness Tw2 of the root portion 4 of the fin collar 2, needs to be within a range from 0.26 to 0.34.

On the other hand, if the result of the relational expression (3.14×D/N)×((Tw1+Tw2)/2)/Tw2 is less than 0.26, in which the relational expression represents the product of the ratio (3.14×D/N) of the circumferential length (3.14×D) of the heat transfer tube 10 having the outer diameter D to the number of threads N of the inner protrusions 11 by the ratio ((Tw1+Tw2)/2)/Tw2) of the mean thickness (Tw1+Tw2)/2 of the intermediate portion 5 of the fin collar 2 to the thickness Tw2 of the root portion 4 then the contact pressure between the intermediate portion 5 of the fin collar 2 and the heat transfer tube 10 will drop and the thermal contact resistance will increase; hence, the heat exchange capacity will drop.

Furthermore, if the result of the relational expression (3.14×D/N)×(Tw1+Tw2)/2)/Tw2 is larger than 0.34, in which the relational expression represents the product of the ratio (3.14×D/N) of the perimeter (3.14×D) of the heat transfer tube 10 having the outer diameter D to the number of threads N of the inner protrusions 11 by the ratio ((Tw1+Tw2)/2)/Tw2 of the mean thickness (Tw1+Tw2)/2 of the intermediate portion 5 of the fin collar 2 to the thickness Tw2 of the root portion 4, then stress will concentrate on the root portion 4 of the fin collar 2, the contact pressure between the intermediate portion 5 of the fin collar 2 and the heat transfer tube 10 will drop, and the thermal contact resistance will increase; hence, the heat exchange capacity will drop.

Note that it is especially preferable that the result of the relational expression (3.14×D/N)×((Tw1+Tw2)/2)/Tw2 is within a range from 0.27 to 0.31, in which the relational expression represents the product of the ratio (3.14×D/N) of the circumferential length (3.14×D) of the heat transfer tube 10 having the outer diameter D to the number of threads N of the inner protrusions 11 and the ratio ((Tw1+Tw2)/2)/Tw2 of the mean thickness (Tw1+Tw2)/2 of the intermediate portion 5 of the fin collar 2 to the thickness Tw2 of the root portion 4.

Accordingly, in the second embodiment, the result of the relational expression (3.14×D/N)×((Tw1+Tw2)/2)/Tw2, which is the product of the ratio (3.14×D/N) of the circumferential length (3.14×D) of the heat transfer tube 10 having the outer diameter D to the number of threads N of the inner protrusions 11 and the ratio (Tw1+Tw2)/2)/Tw2 of the mean thickness (Tw1+Tw2)/2 of the intermediate portion 5 of the fin collar 2 and the thickness Tw2 of the root portion 4, is set so as to be within a range from 0.26 to 0.34.

With this configuration, thermal contact resistance between the fins 1 and the heat transfer tubes 10 is reduced and heat exchange capacity is increased.

Third Embodiment

The third embodiment is an example in which the heat exchanger 20 according to the first embodiment or the second embodiment is employed in a heat exchanging device 30, such as a refrigerator or an air-conditioning apparatus.

Accordingly, the contact resistance between the fins 1 and the heat transfer tubes 10 of the heat exchanger is reduced, and a highly efficient refrigerator or an air-conditioning apparatus with increased heat exchange capacity can be obtained.

Note that the above refrigerator and air-conditioning apparatus according to the invention employs, as its working fluid, any one of an HC single refrigerant, a mixed refrigerant including HC, and a non-azeotropic refrigerant mixture including R32, R410A, R407C, tetrafluoropropene, and an HFC refrigerant having a boiling point that is lower than the tetrafluoropropene; and carbon dioxide is used. In the case of an air-conditioning apparatus, the heat exchanger according to the invention is employed in either one or both of an evaporator and a condenser.

EXAMPLES

A description will next be given of examples of the invention while comparing the examples with comparative examples that depart from the scope of the invention.

As illustrated in Table 1, heat exchangers were fabricated in which the bend of the root portion 4 of the fin collar 2 of the fin 1 has a radius R2 of 0.3 mm and a thickness Tw2 of 0.1 mm, and in which the bend of the re-flared portion 3 has a radius R1 of 0.4 mm and a thickness Tw1 of 0.067 mm or 0.09 mm (Example 1 and Example 2).

Furthermore, heat exchangers were fabricated as comparative examples in which the bend of the root portion 4 of the fin collar 2 of the fin 1 has a radius R2 of 0.3 mm and a thickness Tw2 of 0.1 mm, and in which the bend of the re-flared portion 3 has a radius R1 of 0.4 mm and a thickness Tw1 of 0.05 mm or 0.06 mm (Comparative Example 1 and Comparative Example 1).

TABLE 1

| | Tw1 [mm] | R1 [mm] | Tw2 [mm] | R2 [mm] | (Tw1/R1)/(Tw2/R2) | Heat Exchanger Effectiveness [%] |
|---|---|---|---|---|---|---|
| Comparative Example 1 | 0.05 | 0.4 | 0.1 | 0.3 | 0.38 | 96 |
| Comparative Example 2 | 0.06 | 0.4 | 0.1 | 0.3 | 0.45 | 99 |
| Example 1 | 0.067 | 0.4 | 0.1 | 0.3 | 0.5 | 100.5 |
| Example 2 | 0.09 | 0.4 | 0.1 | 0.3 | 0.68 | 102 |

As it is apparent from Table 1, both of the heat exchangers of Example 1 and Example 2 had a higher heat exchanger effectiveness compared to the heat exchangers of Comparative Example 1 and Comparative Example 2, and had an improved contact heat transfer coefficient.

Subsequently, as illustrated in Table 2, heat exchangers were fabricated in which the bend of the root portion 4 of the fin collar 2 of the fin 1 has a radius R2 of 0.3 mm and a thickness Tw2 of 0.1 mm, and in which the bend of the re-flared portion 3 has a radius R1 of 0.5 mm and a thickness Tw1 of 0.083 mm or 0.09 mm (Example 3 and Example 4).

Furthermore, heat exchangers were fabricated as comparative examples in which the bend of the root portion 4 of the fin collar 2 of the fin 1 has a radius R2 of 0.3 mm and a thickness Tw2 of 0.1 mm, and in which the bend of the re-flared portion 3 has a radius R1 of 0.5 mm and a thickness Tw1 of 0.06 mm or 0.07 mm (Comparative Example 3 and Comparative Example 4).

TABLE 2

| | Tw1 [mm] | R1 [mm] | Tw2 [mm] | R2 [mm] | (Tw1/R1)/(Tw2/R2) | Heat Exchanger Effectiveness [%] |
|---|---|---|---|---|---|---|
| Comparative Example 3 | 0.06 | 0.5 | 0.1 | 0.3 | 0.36 | 95 |
| Comparative Example 4 | 0.07 | 0.5 | 0.1 | 0.3 | 0.42 | 98 |
| Example 3 | 0.083 | 0.5 | 0.1 | 0.3 | 0.5 | 100.5 |
| Example 4 | 0.09 | 0.5 | 0.1 | 0.3 | 0.54 | 101.8 |

As it is apparent from Table 2, both of the heat exchangers of Example 3 and Example 4 had a higher heat exchanger effectiveness compared to the heat exchangers of Comparative Example 3 and Comparative Example 4, and had an improved contact heat transfer coefficient.

Subsequently, as illustrated in Table 3, heat exchangers were fabricated in which the fin collar 2 of the fin 1 has a re-flared portion 3 with a thickness Tw1 of 0.07 mm and a root portion 4 with a thickness Tw2 of 0.1 mm, and in which the heat transfer tube 10 has an outer diameter D of 7 mm and the number N of the threads of the inner protrusions 11 is 55 or 72 (Example 5 and Example 6).

Furthermore, heat exchangers were fabricated as comparative examples in which the fin collar 2 of the fin 1 has a re-flared portion 3 with a thickness Tw1 of 0.07 mm and a root portion 4 with a thickness Tw2 of 0.1 mm, and in which the heat transfer tube 10 has an outer diameter D of 7 mm and 45, 50, or 80 threads N of the inner protrusions 11 (Comparative Example 5, Comparative Example 6, and Comparative Example 7).

TABLE 3

| | Outer Diameter D [mm] | Number of Threads N [—] | Tw1 [mm] | Tw2 [mm] | 3.14 * Outer Diameter (D)/Number of Threads (N) * ((Tw1/Tw2)/2)/Tw2 | Heat Exchanger Effectiveness [%] |
|---|---|---|---|---|---|---|
| Comparative Example 5 | 7 | 45 | 0.07 | 0.1 | 0.42 | 92 |
| Comparative Example 6 | 7 | 50 | 0.07 | 0.1 | 0.37 | 97 |
| Comparative Example 7 | 7 | 80 | 0.07 | 0.1 | 0.23 | 97 |
| Example 5 | 7 | 55 | 0.07 | 0.1 | 0.34 | 101 |
| Example 6 | 7 | 72 | 0.07 | 0.1 | 0.26 | 101.5 |

As it is apparent from Table 3, both of the heat exchangers of Example 5 and Example 6 had a higher heat exchanger effectiveness compared to the heat exchangers of Comparative Example 5, Comparative Example 6, and Comparative Example 7, and had an improved contact heat transfer coefficient.

Furthermore, as illustrated in Table 4, heat exchangers were fabricated in which the fin collar 2 of the fin 1 has a re-flared portion 3 with a thickness Tw1 of 0.09 mm and a root portion 4 with a thickness Tw2 of 0.1 mm, and in which the heat transfer tube 10 has an outer diameter D of 7 mm and 60 or 80 threads N of the inner protrusions 11 (Example 7 and Example 8).

In addition, heat exchangers were fabricated as comparative examples in which the fin collar 2 of the fin 1 has a re-flared portion 3 with a thickness Tw1 of 0.09 mm and a root portion 4 with a thickness Tw2 of 0.1 mm, and in which the heat transfer tube 10 has an outer diameter D of 7 mm and 50, 55, or 85 threads N of the inner protrusions 11 (Comparative Example 8, Comparative Example 9, and Comparative Example 10).

TABLE 4

| | Outer Diameter D [mm] | Number of Threads N [—] | Tw1 [mm] | Tw2 [mm] | 3.14 * Outer Diameter (D)/Number of Threads (N) * ((Tw1/Tw2)/2)/Tw2 | Heat Exchanger Effectiveness [%] |
|---|---|---|---|---|---|---|
| Comparative Example 8 | 7 | 50 | 0.09 | 0.1 | 0.41 | 91 |
| Comparative Example 9 | 7 | 55 | 0.09 | 0.1 | 0.37 | 97 |
| Comparative Example 10 | 7 | 85 | 0.09 | 0.1 | 0.24 | 98 |
| Example 7 | 7 | 60 | 0.09 | 0.1 | 0.34 | 101 |
| Example 8 | 7 | 80 | 0.09 | 0.1 | 0.26 | 101.5 |

As it is apparent from Table 4, both of the heat exchangers of Example 7 and Example 8 had a higher heat exchanger effectiveness compared to the heat exchangers of Comparative Example 8, Comparative Example 9, and Comparative Example 10, and had an improved contact heat transfer coefficient.

The invention claimed is:

1. A fin and tube heat exchanger, comprising:

a plurality of heat transfer tubes arranged in parallel to each other; and a plurality of plate-shaped fins provided orthogonally to the heat transfer tubes, each of the heat transfer tubes being in contact with fin collars of the plate-shaped fins and being inserted along the fin collars, wherein each fin collar includes a re-flared portion and a root portion, each re-flared portion and each root portion includes a bend, a thickness of the re-flared portion is smaller than a thickness of the root portion, a radius of the bend of the re-flared portion is larger than a radius of the bend of the root portion, each fin collar has a ratio of the thickness to the radius of the bend of the re-flared portion that is one half or more of a ratio of the thickness to the radius of the bend of the root portion;

wherein a flat intermediate portion is formed between the bend in the re-flared portion and the bend in the root portion of each fin collar; and wherein each heat transfer tube has a plurality of threads of inner protrusions configured as a product of:

a ratio of a circumferential length to a total number of threads of inner protrusions of each heat transfer tube by a ratio of a mean thickness of the intermediate portion to the thickness of the root portion, and the product is within a range from 0.26 to 0.34.

2. A refrigerator comprising the heat exchanger of claim 1.

3. An air-conditioning apparatus comprising the heat exchanger of claim 1.

4. A fin and tube heat exchanger, comprising:

a plurality of heat transfer tubes arranged in parallel to each other;

a plurality of plate-shaped fins provided orthogonally to the heat transfer tubes, each of the heat transfer tubes being in contact with fin collars of the plate-shaped fins and being inserted along the fin collars; wherein each fin collar includes a re-flared portion and a root portion, each re-flared portion and each root portion of the fin collar includes a bend, a flat intermediate portion is formed between the bend in the re-flared portion and the bend in the root portion of each fin collar, and each heat transfer tube has an outer diameter (D), a thickness (Tw1) of the re-flared portion is smaller than a thickness (Tw2) of the root portion, a radius (R1) of the bend of the re-flared portion is larger than a radius (R2) of the bend of the root portion, and each heat transfer tube has a plurality of threads of inner protrusions configured as a product of a ratio (3.14×D/N) of a circumferential length (114×D) to a total number (N) of threads of inner protrusions of each heat transfer tube by a ratio of a mean thickness of the intermediate portion to the thickness of the root portion, $$\left(\left(3.14\times\frac{D}{N}\right)\times\left(\frac{(Tw1+Tw2)}{2}\right)\Big/Tw2\right),$$

and the product is within a range from 0.26 to 0.34.

* * * * *